US012767428B2

(12) United States Patent
Hsieh et al.

(10) Patent No.: US 12,767,428 B2
(45) Date of Patent: Oct. 20, 2026

(54) DEFORMABLE CONTAINER AND GAS STORAGE DEVICE

(71) Applicant: Wiwynn Corporation, New Taipei City (TW)

(72) Inventors: Hsien-Chieh Hsieh, New Taipei City (TW); Fu-Sheng Cheng, New Taipei City (TW)

(73) Assignee: Wiwynn Corporation City, New Taipei (TW)

( * ) Notice: Subject to any disclaimer, the term of this patent is extended or adjusted under 35 U.S.C. 154(b) by 50 days.

(21) Appl. No.: 18/776,279

(22) Filed: Jul. 18, 2024

(65) Prior Publication Data

US 2025/0282541 A1 Sep. 11, 2025

(30) Foreign Application Priority Data

Mar. 8, 2024 (TW) ..... 113108493

(51) Int. Cl.
*B65D 88/52* (2006.01)
*B65D 88/00* (2006.01)

(52) U.S. Cl.
CPC ..... *B65D 88/52* (2013.01); *B65D 88/005* (2013.01)

(58) Field of Classification Search
CPC ..... B65D 77/06; B65D 77/065; B65D 88/52; B65D 2001/0827
USPC ..... 220/6, 495.01, 666; 137/68.23; 383/42; 222/105
See application file for complete search history.

(56) References Cited

U.S. PATENT DOCUMENTS 2,432,025 A * 12/1947 Lorenz ..... B64D 37/06 220/666
2,804,257 A * 8/1957 Hasler ..... B65D 31/145 383/44
3,948,436 A * 4/1976 Bambara ..... B32B 29/007 428/318.6
4,113,146 A * 9/1978 Williamson ..... B65D 88/1668 426/106
4,155,469 A * 5/1979 Cole ..... B60P 1/56 222/105
4,257,535 A * 3/1981 Mellett ..... B29C 66/61 222/83
4,306,668 A * 12/1981 Love ..... B65D 90/205 222/185.1
4,601,410 A * 7/1986 Bond ..... B65D 75/5877 493/929
5,037,002 A * 8/1991 Tschanen ..... B65D 33/02 220/666
5,129,534 A * 7/1992 Dunn ..... B65D 11/06 220/4.12

(Continued)

FOREIGN PATENT DOCUMENTS

EP 2 797 833 B1 8/2016

*Primary Examiner* — Prince Pal
(74) *Attorney, Agent, or Firm* — Winston Hsu

(57) ABSTRACT

A deformable container includes a bag body, a first connecting member and a second connecting member. The bag body is formed with an opening. The first connecting member has a first tube portion and a first annular flange protruding from an end of the first tube portion. The first tube portion passes through the opening to be exposed from the bag body. The bag body is pressed against a pressing surface of the first annular flange. The second connecting member has a second tube portion. The second tube portion is sleeved on the first tube portion.

14 Claims, 8 Drawing Sheets

(56) References Cited

U.S. PATENT DOCUMENTS 5,524,789 A * 6/1996 Jackman ..... B65D 5/40 220/666
RE35,540 E * 6/1997 Davies ..... B65D 83/62 222/394
5,647,511 A * 7/1997 Bond ..... B67D 3/04 222/464.2
5,749,493 A * 5/1998 Boone ..... B65D 77/06 222/105
5,884,648 A * 3/1999 Savage ..... F16L 37/36 137/614.04
5,915,596 A * 6/1999 Credle, Jr. ..... B65D 77/065 222/105
6,045,006 A * 4/2000 Frazier ..... B65D 77/065 222/464.2
6,062,430 A * 5/2000 Fuchs ..... B05B 11/046 222/105
6,228,011 B1 * 5/2001 Takemura ..... B65D 77/062 493/143
6,755,324 B2 * 6/2004 Geshay ..... B65D 77/067 222/105
6,848,596 B2 * 2/2005 Balz ..... B65D 75/5883 222/105
6,883,683 B1 * 4/2005 Cunningham ..... B65D 77/065 383/41
7,004,209 B2 * 2/2006 Davis ..... B65D 75/5877 141/114
7,334,702 B2 * 2/2008 Cunningham ..... B65D 75/58 383/41
7,534,040 B2 * 5/2009 Brans ..... B65D 77/06 383/122
7,832,576 B2 * 11/2010 Cohn ..... B65D 75/5877 215/11.1
8,075,188 B2 * 12/2011 Plunkett ..... B65D 77/061 383/105
8,651,327 B2 * 2/2014 Cutting ..... B01L 3/52 222/464.2
9,321,558 B2 * 4/2016 Callahan ..... B65D 33/02
9,394,088 B2 * 7/2016 Bellmore ..... G01F 11/028
9,643,830 B2 * 5/2017 Kuhn ..... B67D 1/0831
9,862,532 B2 * 1/2018 McRae ..... B65D 85/72
10,245,336 B2 * 4/2019 Tamarindo ..... A61L 2/087
11,691,799 B2 * 7/2023 Digonnet ..... B65D 77/065 222/105
2001/0017998 A1 * 8/2001 Terazawa ..... B65D 77/06 399/258
2003/0205583 A1 * 11/2003 Provenza ..... B65D 77/062 222/105
2005/0117818 A1 * 6/2005 Brans ..... B65D 77/06 383/107
2005/0152801 A1 * 7/2005 Chen ..... B65D 77/062 417/572
2005/0173439 A1 * 8/2005 Chen ..... B65D 81/2023 220/495.06
2006/0278656 A1 * 12/2006 Ross ..... B65D 77/067 222/105
2007/0284371 A1 * 12/2007 Anderson ..... B65D 7/045 222/397
2008/0267538 A1 * 10/2008 Stephenson ..... B65D 77/065 383/33
2009/0078721 A1 * 3/2009 Hoffman ..... B65D 77/06 222/105
2009/0084834 A1 * 4/2009 Duyst ..... B65D 5/705 229/120.01
2009/0101651 A1 * 4/2009 Rasmussen ..... B65D 75/54 220/495.01
2010/0276448 A1 * 11/2010 Moretti ..... B05B 15/30 222/105
2011/0036846 A1 * 2/2011 Corbett ..... B65D 25/16 220/495.03
2011/0083768 A1 * 4/2011 Sims ..... B65D 90/047 141/2
2011/0101025 A1 * 5/2011 Walters ..... B65D 83/62 222/402.1
2012/0024896 A1 * 2/2012 Scobey ..... B67D 3/007 222/105
2012/0187015 A1 * 7/2012 Kasiwabara ..... B65D 81/03 206/484.1
2012/0199614 A1 * 8/2012 Cutting ..... B01L 3/52 222/464.2
2012/0217265 A1 * 8/2012 Edwards ..... B65D 77/067 53/469
2012/0275727 A1 * 11/2012 Chang ..... B65D 75/5877 493/194
2012/0318821 A1 * 12/2012 Merner ..... B67D 3/04 222/105
2015/0108165 A1 * 4/2015 Merner ..... B65D 77/067 222/105
2016/0046427 A1 * 2/2016 Bellmore ..... B65D 75/5877 383/42
2016/0200494 A1 * 7/2016 Harada ..... A61J 9/001 222/206
2016/0229626 A1 * 8/2016 Claeys ..... B65D 88/005
2016/0263601 A1 * 9/2016 Micnerski ..... B67D 1/102
2016/0347526 A1 * 12/2016 McRae ..... B65D 5/563
2017/0225872 A1 * 8/2017 Collie ..... A45C 11/22
2017/0240334 A1 * 8/2017 Myerscough ..... B65D 5/068
2017/0283235 A1 * 10/2017 Boissy ..... B67D 1/0016
2018/0327130 A1 * 11/2018 Taruno ..... B65D 1/023
2018/0353983 A1 * 12/2018 Moretti ..... B29C 66/53263
2019/0185258 A1 * 6/2019 Thiessen ..... B65D 88/30
2019/0225378 A1 * 7/2019 Barnett ..... A47G 23/0216
2019/0359472 A1 * 11/2019 Neelin ..... B67D 3/0067
2020/0047991 A1 * 2/2020 Ford ..... B65D 88/32
2020/0055723 A1 * 2/2020 Johnson ..... B67D 3/0083
2020/0062478 A1 * 2/2020 Evans ..... B65D 77/065
2020/0071049 A1 * 3/2020 Abe ..... B65D 75/566
2020/0229353 A1 * 7/2020 Carter ..... B65D 88/54
2020/0396903 A1 * 12/2020 Kosior ..... B65D 88/52
2021/0309450 A1 * 10/2021 Sleeman ..... B65G 47/19
2021/0380321 A1 * 12/2021 Digonnet ..... B65D 77/065
2024/0240871 A1 * 7/2024 Hsieh ..... F28D 15/06
2024/0343475 A1 * 10/2024 Yepez ..... B65D 88/1606
2024/0417161 A1 * 12/2024 Pedretti-Rodi ..... B65D 88/54
2025/0136343 A1 * 5/2025 Green ..... B65D 75/566
2025/0282541 A1 * 9/2025 Hsieh ..... B65D 88/52
2026/0027601 A1 * 1/2026 Swirniak ..... B08B 9/08

* cited by examiner

DEFORMABLE CONTAINER AND GAS STORAGE DEVICE

BACKGROUND OF THE INVENTION

1. Field of the Invention

The invention relates to a deformable container and a gas storage device and, more particularly, to a deformable container capable of effectively preventing gas from leaking and a gas storage device equipped with the deformable container.

2. Description of the Prior Art

An immersion cooling system uses a cooling liquid to dissipate heat from electronic components by a phase change manner. The cooling liquid evaporates into gas after absorbing the heat generated by the electronic component. Thus, the immersion cooling system is usually equipped with a gas storage device for temporarily storing the gas of the cooling liquid and controlling the pressure. A container of the gas storage device is connected to a cooling tank by a tube. However, the joint surface between the container of the gas storage device and the tube is easily broken due to expansion and contraction, thereby resulting in gas leakage.

SUMMARY OF THE INVENTION

According to an embodiment of the invention, a deformable container comprises a bag body, a first connecting member and a second connecting member. The bag body is formed with an opening. The first connecting member has a first tube portion and a first annular flange protruding from an end of the first tube portion. The first tube portion passes through the opening to be exposed from the bag body. The bag body is pressed against a pressing surface of the first annular flange. The second connecting member has a second tube portion. The second tube portion is sleeved on the first tube portion.

According to another embodiment of the invention, a gas storage device comprises a frame and a deformable container. The deformable container is connected to the frame. The deformable container comprises a bag body, a first connecting member and a second connecting member. The bag body is formed with an opening. The first connecting member has a first tube portion and a first annular flange protruding from an end of the first tube portion. The first tube portion passes through the opening to be exposed from the bag body. The bag body is pressed against a pressing surface of the first annular flange. The second connecting member has a second tube portion. The second tube portion is sleeved on the first tube portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
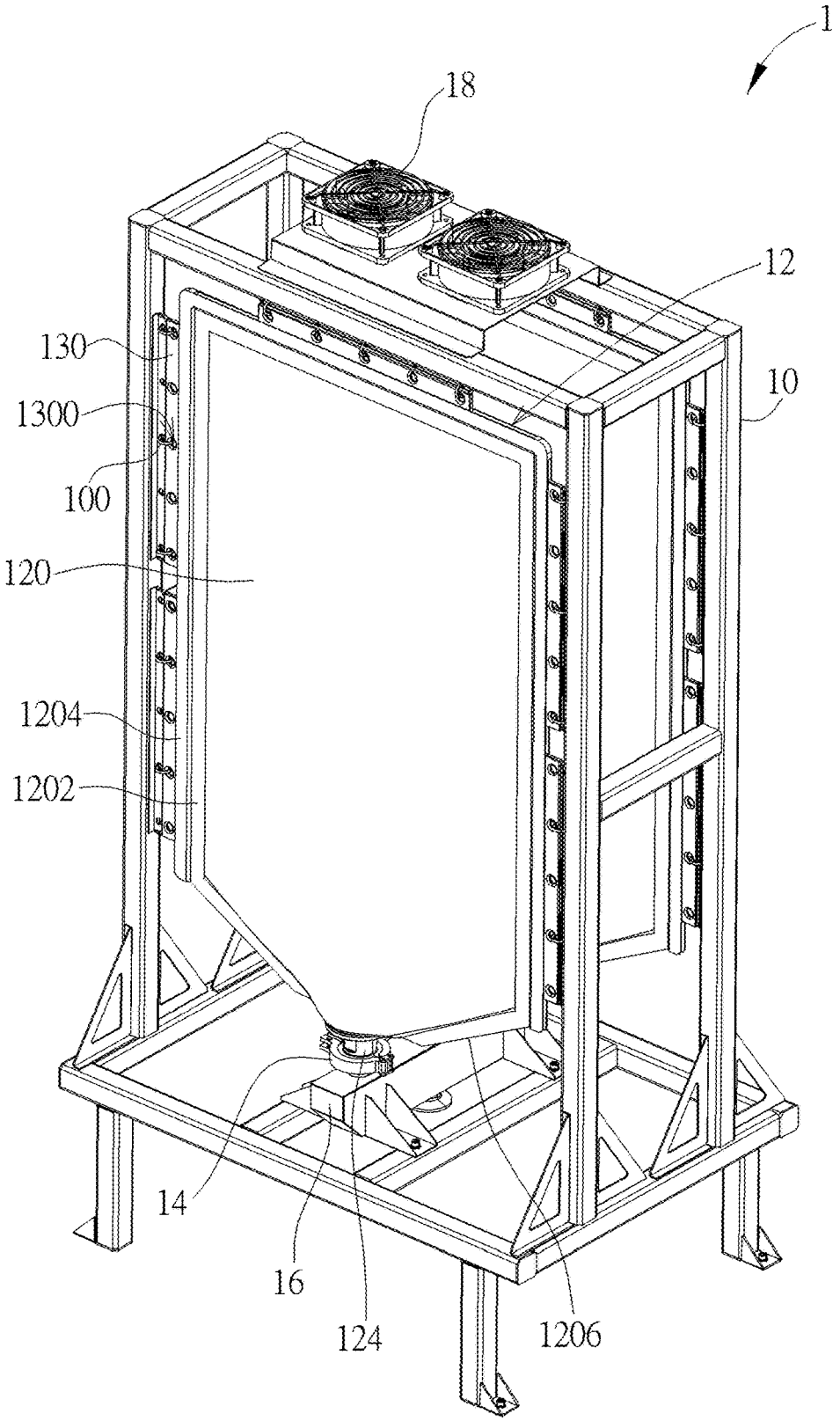
FIG. 1 is a perspective view illustrating a gas storage device according to an embodiment of the invention.
Figure 2:
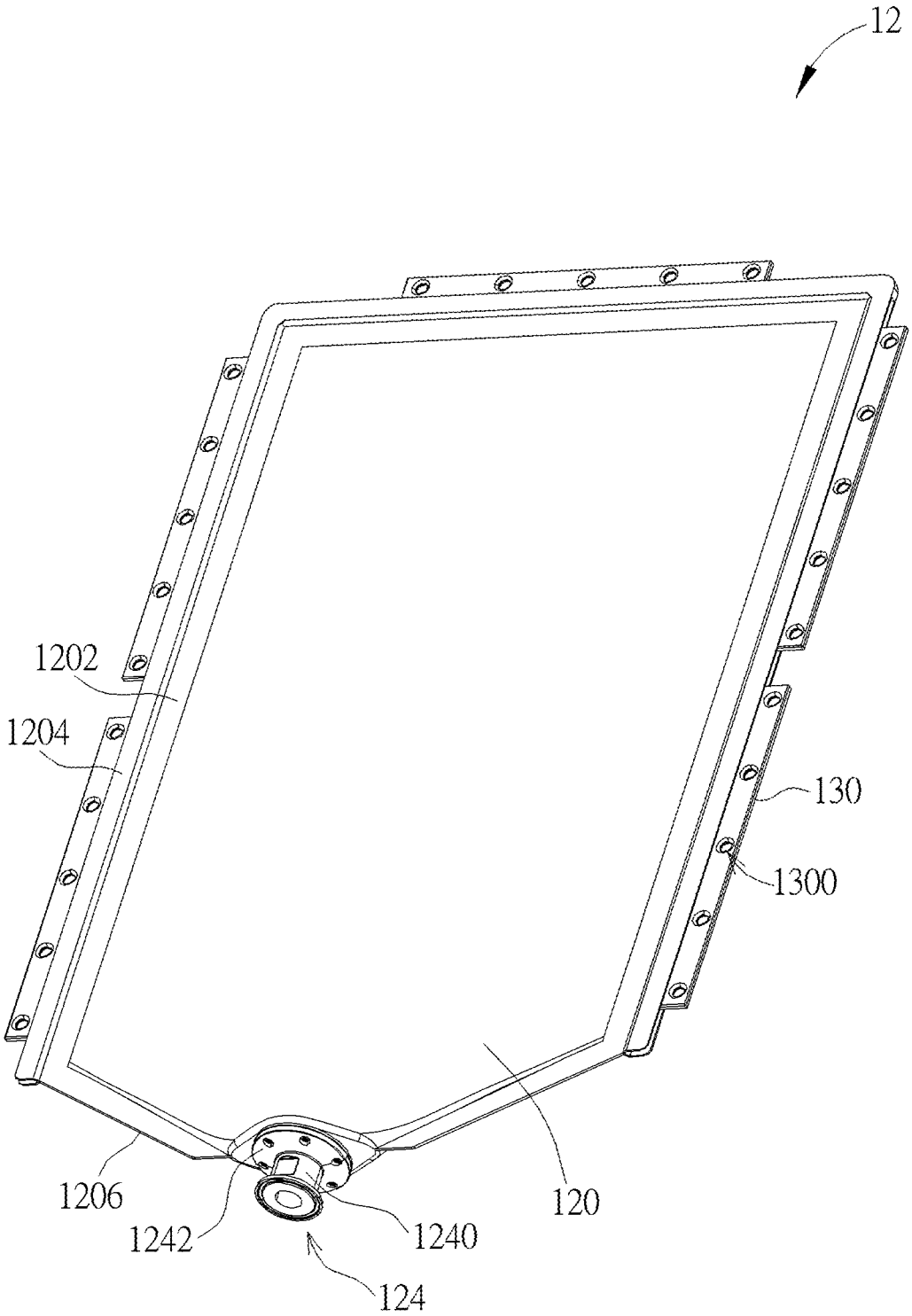
FIG. 2 is a perspective view illustrating a deformable container shown in FIG. 1.
Figure 3:
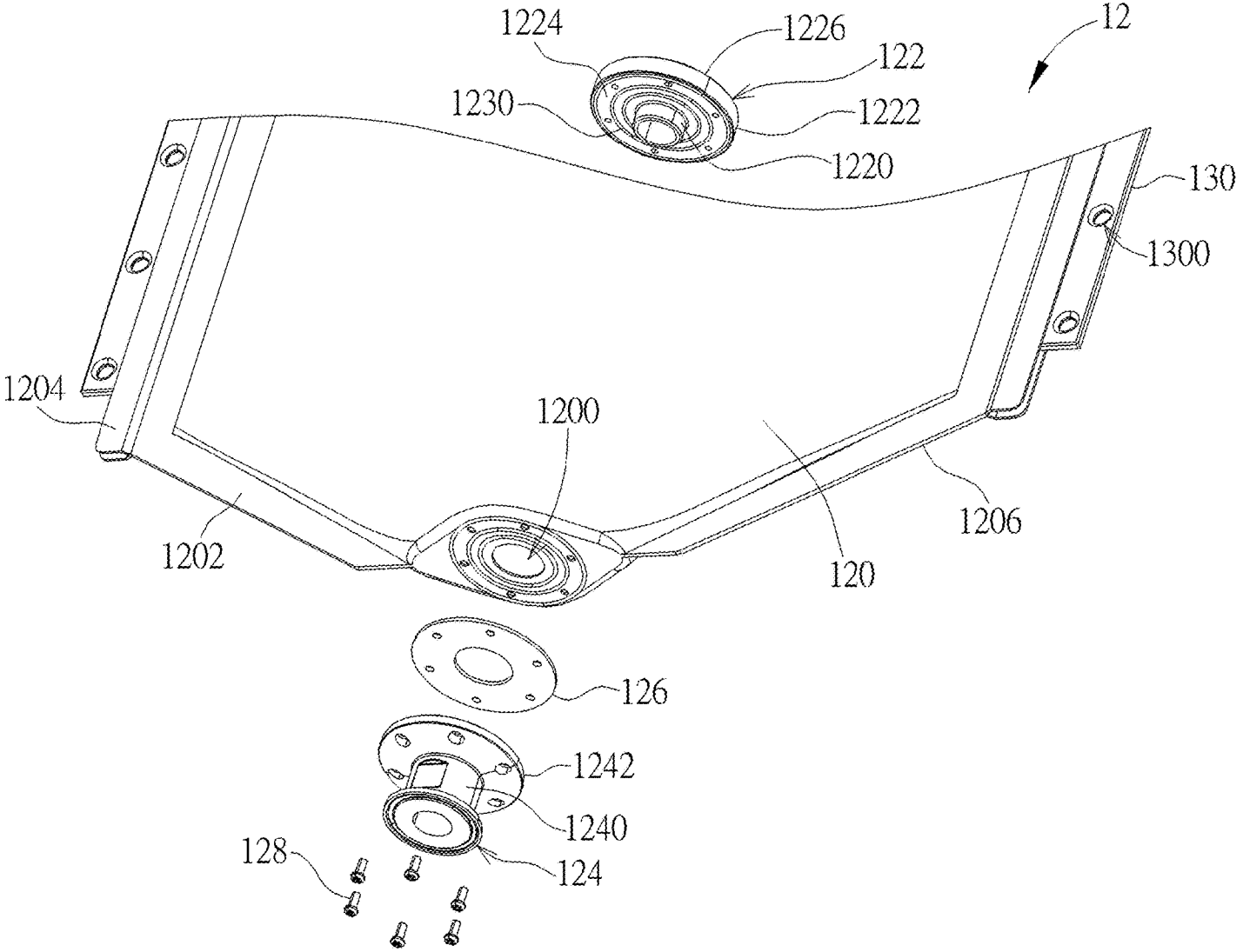
FIG. 3 is a partial exploded view illustrating the deformable container shown in FIG. 2.
Figure 4:
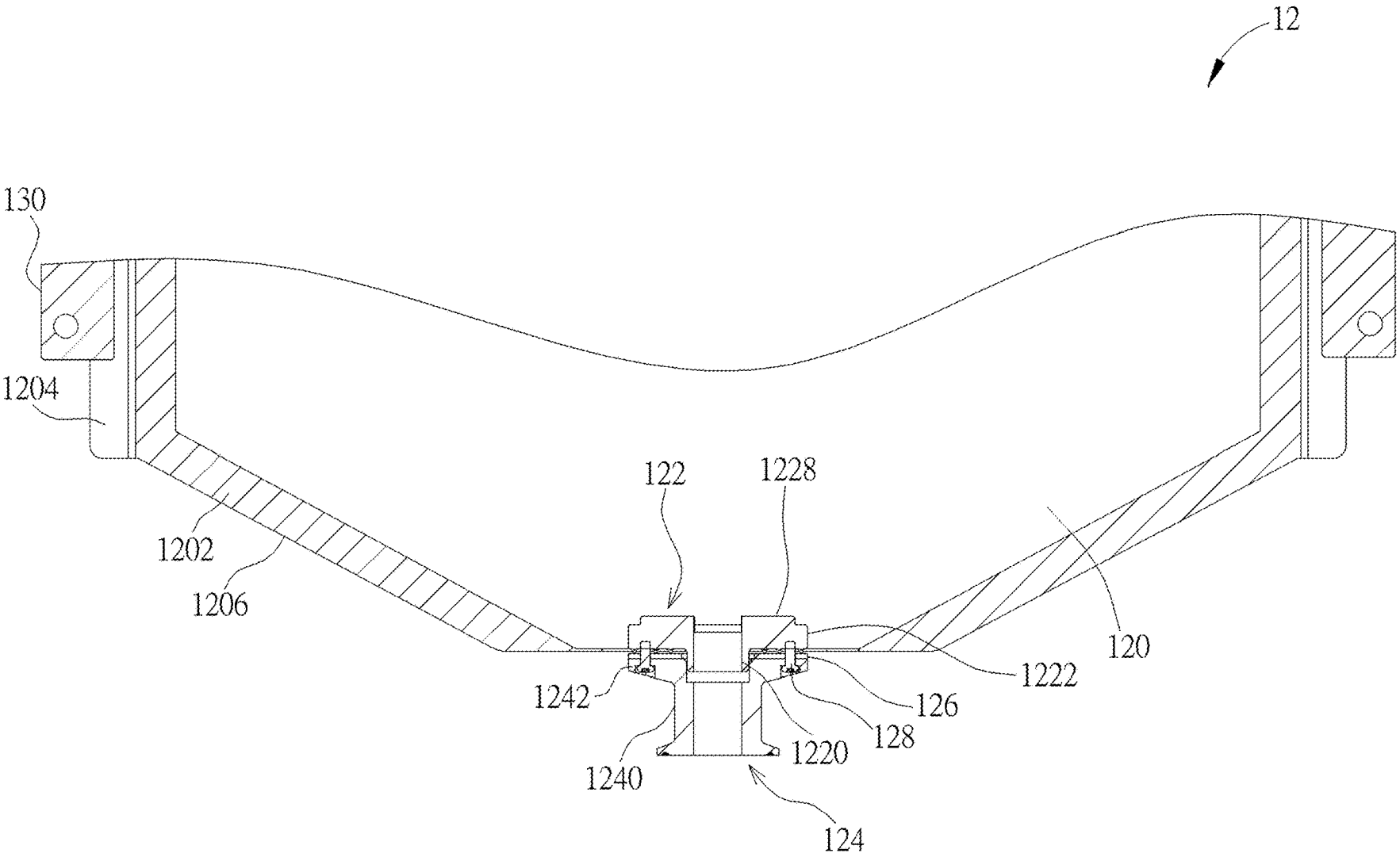
FIG. 4 is a partial sectional view illustrating the deformable container shown in FIG. 2.
Figure 5:
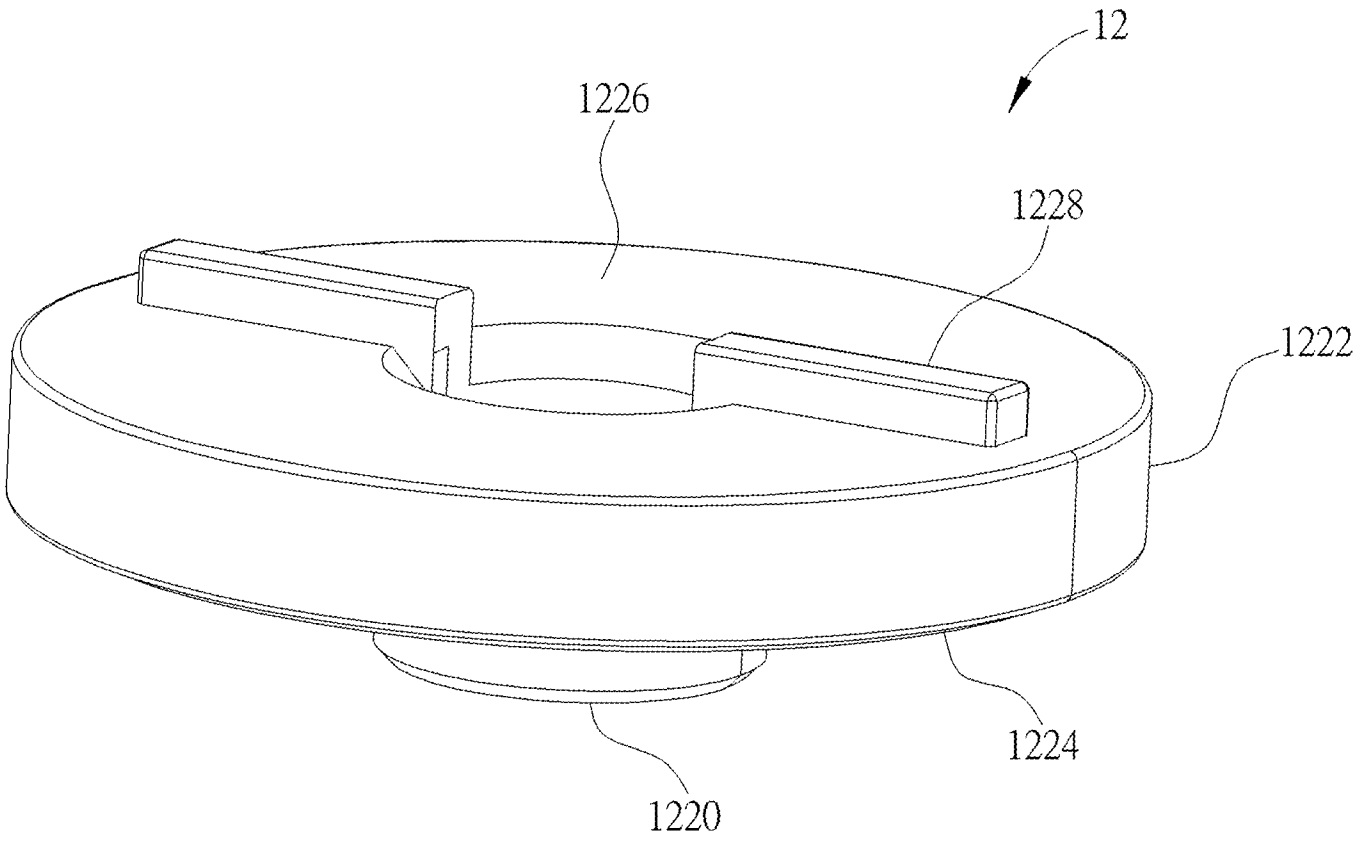
FIG. 5 is a perspective view illustrating a first connecting member shown in FIG. 3 from another viewing angle.

Referring to FIGS. 1 to 5, FIG. 1 is a perspective view illustrating a gas storage device 1 according to an embodiment of the invention, FIG. 2 is a perspective view illustrating a deformable container 12 shown in FIG. 1, FIG. 3 is a partial exploded view illustrating the deformable container 12 shown in FIG. 2, FIG. 4 is a partial sectional view illustrating the deformable container 12 shown in FIG. 2, and FIG. 5 is a perspective view illustrating a first connecting member 122 shown in FIG. 3 from another viewing angle.

As shown in FIG. 1, the gas storage device 1 comprises a frame 10 and a deformable container 12. The deformable container 12 is connected to the frame 10. The gas storage device 1 uses the frame 10 to support the deformable container 12, which may keep the deformable container 12 upright to prevent the deformable container 12 from tipping over and affecting its expansion and contraction performance. It should be noted that the structure of the frame 10 may be designed according to practical applications, so the invention is not limited to the embodiment shown in the figure.

In this embodiment, the deformable container 12 may be connected to an airtight base 16 through a quick release connector 14, and the airtight base 16 may be connected to a cooling tank of an immersion cooling system (not shown) through a tube (not shown). In general, the cooling tank may store a cooling liquid (e.g. dielectric liquid) with a low boiling point. An electronic component (not shown) may be immersed in the cooling liquid. The cooling liquid evaporates and changes into gas after absorbing the heat generated by the electronic component. The deformable container 12 is used to temporarily store the gas of the cooling liquid and control the pressure.

In this embodiment, two deformable containers 12 may be connected to the frame 10 and the airtight base 16 side by side. Furthermore, at least one fan 18 may be disposed on the top of the frame 10, wherein the fan 18 may be disposed between the two deformable containers 12. Accordingly, the downward airflow generated by the fan 18 may dissipate heat from the two deformable containers 12 at the same time. It should be noted that the number of frames 10, deformable containers 12, quick release connectors 14, airtight bases 16 and fans 18 may be adjusted according to practical applications, which make the gas storage device 1 expandable.

As shown in FIGS. 2 to 4, the deformable containers 12 comprises a bag body 120, a first connecting member 122, a second connecting member 124, a sealing member 126, a plurality of fixing members 128 and a plurality of support members 130. The bag body 120 is formed with an opening 1200. In this embodiment, the bag body 120 may be made of plastic film and aluminum foil, the first connecting member 122 and the support members 130 may be made of plastic, the second connecting member 124 may be made of metal or plastic, the sealing member 126 may be an O-ring, and the fixing members 128 may be screws, but the invention is not so limited. In an embodiment, when the bag body 120 is made of plastic film and aluminum foil, the aluminum foil is located between the upper and lower layers of the plastic film, wherein the upper and lower layers of the plastic films are used to be connected with each other and the aluminum foil is used to block light. It should be noted that the aluminum foil may be omitted according to practical applications. In an embodiment, when both the second connecting member 124 and the quick release connector 14 are made of metal, the connecting strength between the second connecting member 124 and the quick release connector 14 may be enhanced.

The first connecting member 122 has a first tube portion 1220 and a first annular flange 1222 protruding from an end of the first tube portion 1220. The first tube portion 1220 of the first connecting member 122 passes through the opening 1200 of the bag body 120 to be exposed from the bag body 120. Furthermore, the bag body 120 is pressed against a pressing surface 1224 of the first annular flange 1222 of the first connecting member 122.

In this embodiment, a non-pressing surface 1226 of the first annular flange 1222 may have a positioning structure 1228, wherein the non-pressing surface 1226 is opposite to the pressing surface 1224. In the invention, the positioning structure 1228 of the first connecting member 122 may be inserted into a positioning hole of a fixture (not shown) first. Then, before the periphery of the bag body 120 is pressed, the opening 1200 of the bag body 120 is sleeved on the first tube portion 1220 of the first connecting member 122. Then, the bag body 120 and the pressing surface 1224 of the first annular flange 1222 are hot pressed and then the periphery of the bag body 120 is hot pressed. Accordingly, the first tube portion 1220 of the first connecting member 122 passes through the opening 1200 of the bag body 120 to be exposed from the bag body 120, and the first annular flange 1222 of the first connecting member 122 is wrapped in the bag body 120. After the bag body 120 and the pressing surface 1224 of the first annular flange 1222 of the first connecting member 122 are hot pressed, the bag body 120 will be tightly connected with the pressing surface 1224 of the first annular flange 1222, thereby enhancing the sealing effect between the bag body 120 and the first connecting member 122 and effectively preventing gas leakage. Furthermore, since the bag body 120 and the pressing surface 1224 of the first annular flange 1222 are pressed together in a surface contact manner, the connecting strength between the bag body 120 and the first annular flange 1222 of the first connecting member 122 will be effectively enhanced, so as to prevent the joint between the bag body 120 and the first annular flange 1222 of the first connecting member 122 from breaking due to expansion and contraction.

In this embodiment, the pressing surface 1224 of the first annular flange 1222 may have a protruding structure 1230, as shown in FIG. 3. The bag body 120 may be pressed against the protruding structure 1230 to increase the contact area between the bag body 120 and the first annular flange 1222, so as to enhance the connecting strength between the bag body 120 and the first annular flange 1222. In this embodiment, the protruding structure 1230 may be composed of a plurality of protruding ribs arranged in concentric circles, but the invention is not so limited.

The second connecting member 124 has a second tube portion 1240 and a second annular flange 1242 protruding from an end of the second tube portion 1240. After the bag body 120 and the first annular flange 1222 of the first connecting member 122 are hot pressed, the sealing member 126 is sleeved on the first tube portion 1220 of the first connecting member 122 and abuts against the bag body 120. Then, the second tube portion 1240 of the second connecting member 124 is sleeved on the first tube portion 1220 of the first connecting member 122, such that the sealing member 126 and the bag body 120 are sandwiched between the first annular flange 1222 of the first connecting member 122 and the second annular flange 1242 of the second connecting member 124. Then, the fixing members 128 pass through the second annular flange 1242, the sealing member 126 and the bag body 120 in sequence to be fixed to the first annular flange 1222, such that the second annular flange 1242 presses the sealing member 126 and the bag body 120 tightly. Then, the second connecting member 124 may be connected to the airtight base 16 through the quick release connector 14, as shown in FIG. 1. The sealing member 126 can prevent gas from leaking from a gap between the first connecting member 122 and the second connecting member 124.

In this embodiment, the first annular flange 1222 may be formed with a plurality of fixing holes (e.g. screw holes), and the second annular flange 1242, the sealing member 126 and the bag body 120 may be formed with a plurality of through holes corresponding to the fixing holes, such that the fixing members 128 may pass through the through holes of the second annular flange 1242, the sealing member 126 and the bag body 120 in sequence to be fixed to the fixing holes of the first annular flange 1222.

The support members 130 are pressed against a periphery of the bag body 120. In this embodiment, the periphery of the bag body 120 may be formed with a first pressing region 1202 and a second pressing region 1204, wherein the second pressing region 1204 surrounds the first pressing region 1202. The support members 130 may be pressed against the second pressing region 1204. In an embodiment, when hot pressing the periphery of the bag body 120, a specific width (e.g. 30 cm) may be reserved around the bag body 120. Then, the first pressing region 1202 is formed by hot pressing the upper and lower layers of the plastic film with a first width (e.g. 10 cm) of the specific width close to the inside of the bag body 120. Then, a part of each support member 130 is placed between the upper and lower layers of the plastic film at a second width (e.g. 20 cm) of the specific width close to the outside of the bag body 120. Then, the upper and lower layers of the plastic film are hot pressed to form the second pressing region 1204, and another part of each support member 130 is exposed from the bag body 120. Since the second pressing region 1204 surrounds the first pressing region 1202, the first pressing region 1202 will not be broken due to the pulling of the support member 130. Accordingly, the sealing effect of the first pressing region 1202 can be ensured.

As shown in FIG. 1, each of the support members 130 may be formed with a plurality of hanging holes 1300, and the frame 10 may comprise a plurality of hanging rings 100. The hanging holes 1300 may be hung on the hanging rings 100, such that the deformable container 12 is connected to the frame 10 by the support members 130. Accordingly, the deformable container 12 may be hung on the frame 10 and keep upright to prevent the deformable container 12 from tipping over and affecting its expansion and contraction performance. It should be noted that the deformable container 12 may be connected to the frame 10 by other fixing or engaging structures, so the invention is not limited to the hanging manner.

In this embodiment, a bottom 1206 of the bag body 120 may be inclined with respect to the first tube portion 1220 of the first connecting member 122 to help recover the liquid condensed from the gas of the cooling liquid.

Figure 6:
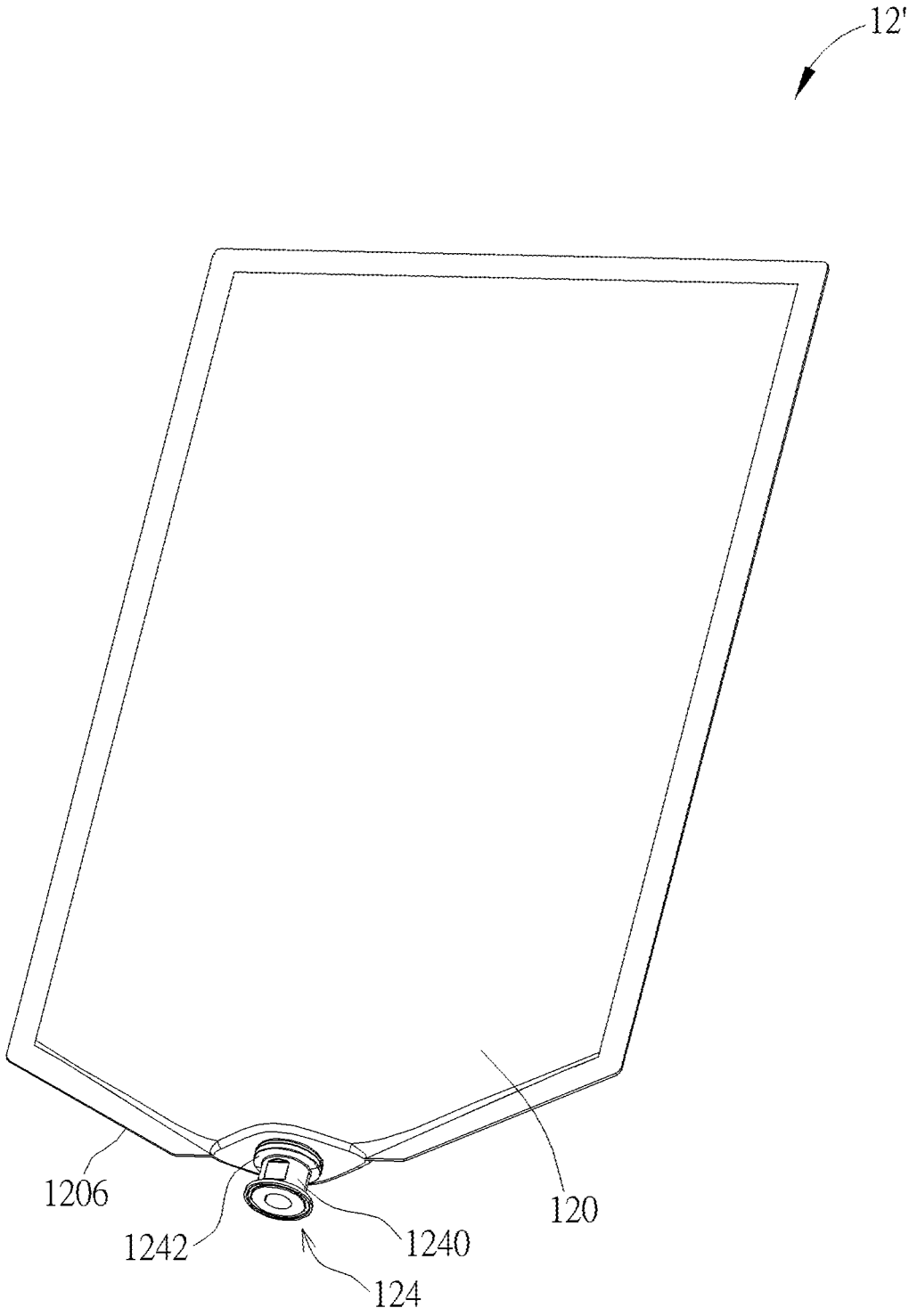
FIG. 6 is a perspective view illustrating a deformable container according to another embodiment of the invention.
Figure 7:
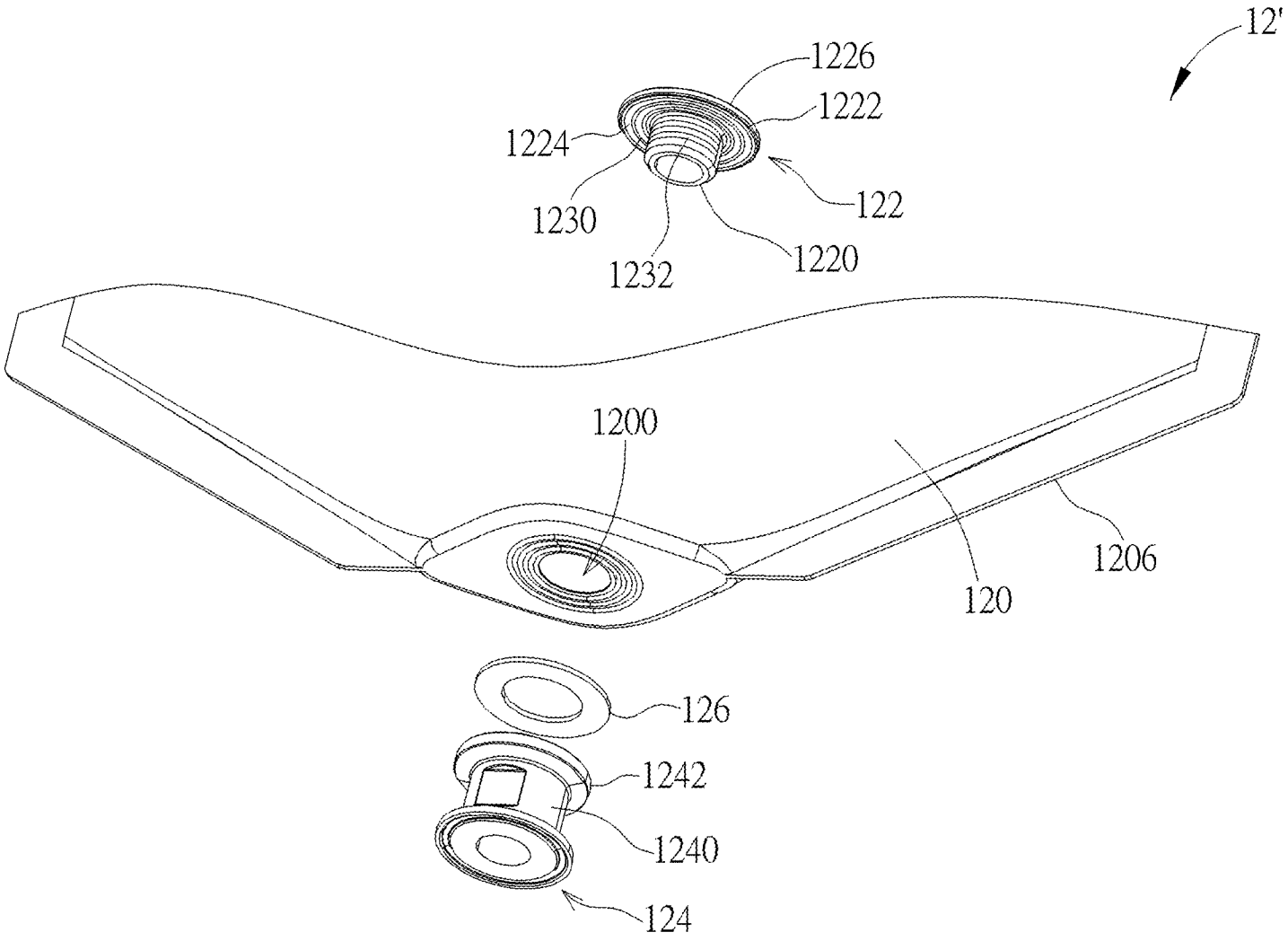
FIG. 7 is a partial exploded view illustrating the deformable container shown in FIG. 6.
Figure 8:
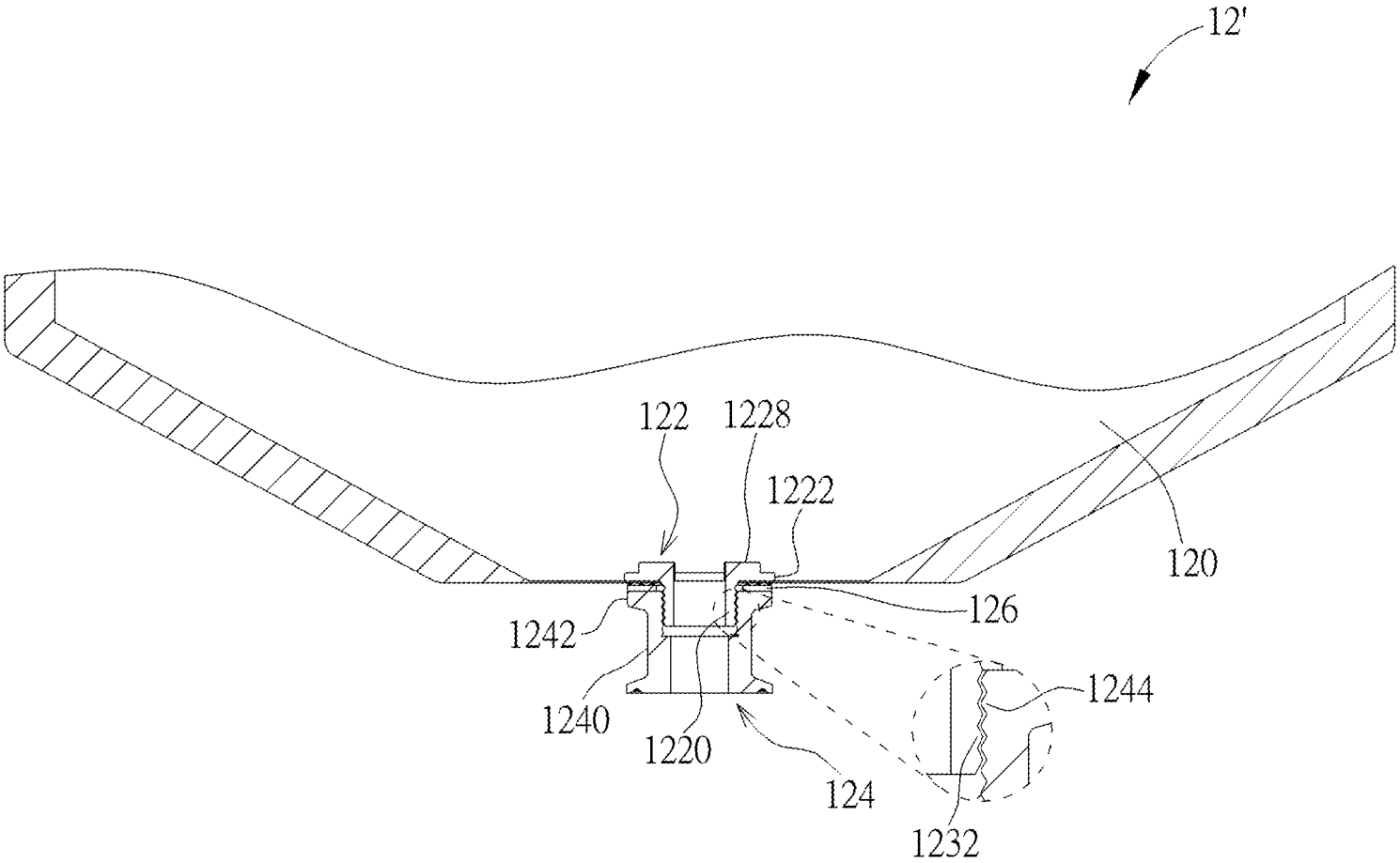
FIG. 8 is a partial sectional view illustrating the deformable container shown in FIG. 6.

Referring to FIGS. 6 to 8, FIG. 6 is a perspective view illustrating a deformable container 12' according to another embodiment of the invention, FIG. 7 is a partial exploded view illustrating the deformable container 12' shown in FIG. 6, and FIG. 8 is a partial sectional view illustrating the deformable container 12' shown in FIG. 6.

In another embodiment, the aforesaid deformable container 12 may be replaced by the deformable container 12' shown in FIGS. 6 to 8. The main difference between the deformable container 12' and the aforesaid deformable container 12 is that the first tube portion 1220 of the first connecting member 122 of the deformable container 12' has an outer thread 1232, and the second tube portion 1240 of the second connecting member 124 of the deformable container 12' has an inner thread 1244. The inner thread 1244 and the outer thread 1232 may be screwed with each other, such that the second connecting member 124 is fixed on the first connecting member 122 and the second annular flange 1242 presses the sealing member 126 and the bag body 120 tightly. Therefore, in this embodiment, the fixing members 128, the through holes and the fixing holes mentioned above may be omitted. It should be noted that the deformable container 12' may also be equipped with the aforesaid support members 130 to be connected with the frame 10 shown in FIG. 1.

As mentioned above, since the bag body and the pressing surface of the first annular flange of the first connecting member are pressed together in a surface contact manner, the connecting strength between the bag body and the first annular flange of the first connecting member will be effectively enhanced, so as to prevent the joint between the bag body and the first annular flange of the first connecting member from breaking due to expansion and contraction. After the bag body and the pressing surface of the first annular flange of the first connecting member are pressed, the bag body will be tightly connected with the pressing surface of the first annular flange, thereby enhancing the sealing effect between the bag body and the first connecting member and effectively preventing gas leakage. Furthermore, the sealing member may be disposed between the first connecting member and the second connecting member to prevent gas from leaking from the gap between the first connecting member and the second connecting member. Moreover, the deformable container may be connected to the frame to keep upright, so as to prevent the deformable container 12 from tipping over and affecting its expansion and contraction performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A deformable container comprising:

a bag body formed with an opening;

a first connecting member having a first tube portion and a first annular flange protruding from an end of the first tube portion, the first tube portion passing through the opening to be exposed from the bag body, the bag body being pressed against a pressing surface of the first annular flange;

a second connecting member having a second tube portion and a second annular flange, the second tube portion being sleeved on the first tube portion, the second annular flange protruding from an end of the second tube portion;

a sealing member sleeved on the first tube portion and abutting against the bag body, the sealing member and the bag body being sandwiched between the first annular flange and the second annular flange; and a plurality of fixing members passing through the second annular flange, the sealing member and the bag body in sequence to be fixed to the first annular flange.

2. The deformable container of claim 1, wherein the pressing surface has a protruding structure and the bag body is pressed against the protruding structure.

3. The deformable container of claim 1, wherein a bottom of the bag body is inclined with respect to the first tube portion.

4. The deformable container of claim 1, further comprising a plurality of support members pressed against a periphery of the bag body.

5. The deformable container of claim 4, wherein the periphery of the bag body is formed with a first pressing region and a second pressing region, the second pressing region surrounds the first pressing region, and the plurality of support members are pressed against the second pressing region.

6. The deformable container of claim 4, wherein each of the plurality of support members is formed with a plurality of hanging holes.

7. The deformable container of claim 1, wherein a non-pressing surface of the first annular flange has a positioning structure and the non-pressing surface is opposite to the pressing surface.

8. A gas storage device comprising:

a frame; and a deformable container connected to the frame, the deformable container comprising:

a bag body formed with an opening;

a first connecting member having a first tube portion and a first annular flange protruding from an end of the first tube portion, the first tube portion passing through the opening to be exposed from the bag body, the bag body being pressed against a pressing surface of the first annular flange;

a second connecting member having a second tube portion and a second annular flange, the second tube portion being sleeved on the first tube portion, the second annular flange protruding from an end of the second tube portion;

a sealing member sleeved on the first tube portion and abutting against the bag body, the sealing member and the bag body being sandwiched between the first annular flange and the second annular flange; and a plurality of fixing members passing through the second annular flange, the sealing member and the bag body in sequence to be fixed to the first annular flange.

9. The gas storage device of claim 8, wherein the pressing surface has a protruding structure and the bag body is pressed against the protruding structure.

10. The gas storage device of claim 8, wherein a bottom of the bag body is inclined with respect to the first tube portion.

11. The gas storage device of claim 8, wherein the deformable container further comprises a plurality of support members pressed against a periphery of the bag body, and the deformable container is connected to the frame by the plurality of support members.

12. The gas storage device of claim 11, wherein the periphery of the bag body is formed with a first pressing region and a second pressing region, the second pressing region surrounds the first pressing region, and the plurality of support members are pressed against the second pressing region.

13. The gas storage device of claim 11, wherein each of the plurality of support members is formed with a plurality of hanging holes, the frame comprises a plurality of hanging rings, and the plurality of hanging holes are hung on the plurality of hanging rings.

14. The gas storage device of claim 8, wherein a non-pressing surface of the first annular flange has a positioning structure and the non-pressing surface is opposite to the pressing surface.

* * * * *